US007087140B1

(12) United States Patent
Menian

(10) Patent No.: US 7,087,140 B1
(45) Date of Patent: Aug. 8, 2006

(54) CARBONIZING WASTE PROCESSING APPARATUS

(76) Inventor: Harry H. Menian, 709 Water's Edge Dr., Apt. 107, Lake Villa, IL (US) 60046

( * ) Notice: Subject to any disclaimer, the term of this patent is extended or adjusted under 35 U.S.C. 154(b) by 668 days.

(21) Appl. No.: 10/217,386

(22) Filed: Aug. 12, 2002

Related U.S. Application Data

(60) Provisional application No. 60/322,109, filed on Sep. 10, 2001.

(51) Int. Cl.
*C10B 21/00* (2006.01)

(52) U.S. Cl. ..... 202/100; 202/105; 202/115; 202/117; 202/152; 202/153; 202/154; 202/155; 202/282; 202/183; 202/185.5; 202/185; 202/208; 202/216; 202/238

(58) Field of Classification Search ..... 201/6, 201/8, 15, 30; 202/85, 86, 91, 100, 105, 202/115, 117, 152–155, 182, 183, 185.5, 202/185, 208, 216, 238, 164, 131, 136, 218, 202/98, 118; 208/347; 165/110
See application file for complete search history.

(56) References Cited

U.S. PATENT DOCUMENTS

| | | | | | |
|---|---|---|---|---|---|
| 1,995,873 | A | * | 3/1935 | Vandegrift et al. | 202/131 |
| 3,554,143 | A | | 1/1971 | Rodgers | 110/10 |
| 3,859,933 | A | | 1/1975 | Von Klenck | 110/8 R |
| 4,111,800 | A | | 9/1978 | Harendza-Harinxma | 210/10 |
| 4,235,676 | A | * | 11/1980 | Chambers | 202/118 |
| 4,280,879 | A | * | 7/1981 | Taciuk | 202/100 |
| 4,734,166 | A | | 3/1988 | Angelo, II | 202/100 |
| 4,878,440 | A | | 11/1989 | Tratz et al. | 110/233 |
| 4,898,107 | A | | 2/1990 | Dickinson | 110/346 |
| 5,101,740 | A | | 4/1992 | Abril | 110/230 |
| 5,592,888 | A | | 1/1997 | Berwein et al. | 110/229 |
| 5,724,900 | A | | 3/1998 | Tratz | 110/346 |
| 5,853,563 | A | * | 12/1998 | Ripley et al. | 208/13 |
| 6,005,149 | A | | 12/1999 | Bishop | 585/241 |

* cited by examiner

*Primary Examiner*—Glenn Caidarola
*Assistant Examiner*—Alexis Wachtel
(74) *Attorney, Agent, or Firm*—John R. Flanagan

(57) ABSTRACT

A carbonizing waste processing apparatus is operable to rotate and heat a radiant tube for carbonizing waste therein so as to generate granular char and vapors from the waste, transfer waste into an upstream end of the tube, temporarily impede movement of the waste through the tube at upstream and downstream locations therein so as to ensure that residence time of the waste in the tube is sufficient at the upstream location to carry out evaporation of moisture from the waste and at the downstream location to elevate the temperature of any solids in the waste for completion of carbonization of the waste, discharge the granular char and vapors from the tube, and flow the generated and discharged vapors through a succession of finned heat exchanger tubes so as to condense and separate the vapors into oil, water and methanol.

19 Claims, 3 Drawing Sheets

CARBONIZING WASTE PROCESSING APPARATUS

This patent application claims the benefit of U.S. provisional application No. 60/322,109, filed Sep. 10, 2001.

BACKGROUND OF THE INVENTION

1. Field of the Invention

The present invention generally relates to a waste processing and, more particularly, is concerned with a carbonizing waste processing apparatus and method.

2. Description of the Prior Art

Up to the present time, the processing of contaminated waste has mainly consisted either of incineration or autoclaving. In either case the outcome is not satisfactory.

In the case of incineration, while the pathogenic waste is rendered safe, the combustion produces undesirable chemical combinations, some odorous, some poisonous, and some carcinogenic, which eventually end up in the water system. Also, incineration produces large amounts of gasses which contribute to the global greenhouse effect.

In the case of autoclaving, which is primarily used for hospitals and contaminated food waste, the guidelines from the environmental agencies require the waste substance be subjected to 350° F. for 15 minutes before it is acceptable for landfill disposal. However, in practice, waste processors place refrigerated or even frozen waste from test laboratories and shipped in large containers in an autoclave for 15 minutes at 350° F. The exposure time, considering the packaging and overall mass, is not even sufficient to thaw the product let along be sufficient to kill any of the pathogens. In ignorance, the waste is then assumed safe and shipped to a landfill site, contaminating the water table for decades to come. Also, neither incineration nor autoclaving allows recycling or retrieval of raw materials from the waste.

Waste processing apparatus alternatives to incineration and autoclaving are known in the prior patent art. Examples of alternative apparatus are disclosed in U.S. Pat. No. 3,554,143 to Rodgers, U.S. Pat. No. 3,859,933 to Von Klenck, U.S. Pat. No. 4,734,166 to Angelo II, and U.S. Pat. No. 5,101,740 to Abril. While these prior art apparatus may be satisfactory in use for the specific purposes for which they were designed, none of them seem to provide an effective solution for the problems at hand.

Consequently, a need still exists for innovation in waste processing which provides a solution to the aforementioned problem in the prior art without introducing any new problems in place thereof.

SUMMARY OF THE INVENTION

The present invention provides a carbonizing waste processing apparatus and method designed to satisfy the aforementioned need. The solution of the apparatus and method of the present invention to the aforementioned problems is to process hospital, household and commercial contaminated food waste through carbonization. Carbonization processing allows the retrieval of most known and usable substances through selective distillation while rendering the waste safe. The only remaining solids, consisting of char made up mostly of carbon and some salts, are prevented from forming $CO_2$ by processing the waste in an inert oxygen-free atmosphere. The outcome is both economically and environmentally beneficial for processing pathogenic and other contaminated food waste without generating large volumes of CO and $CO_2$. It is also important to note that natural anaerobic decaying, which is what takes place in a landfill, produces the same amount of CO and $CO_2$ as incineration but only over a longer period of time.

Accordingly, the present invention is directed to a carbonizing waste processing apparatus which comprises: (a) a radiant tube having upstream and downstream ends and an interior chamber extending between the upstream and downstream ends; (b) means drivingly coupled to the radiant tube for rotating the radiant tube; (c) means for heating the radiant tube to generate a hot zone of a preselected temperature in the interior chamber thereof for carbonizing waste in the radiant tube so as to generate granular char and vapors from the waste; (d) means for successively transferring the waste into the upstream end of the radiant tube; (e) means disposed at upstream and downstream locations in the radiant tube for temporarily impeding movement of the waste through the interior chamber of the radiant tube from the upstream end to the downstream end so as to ensure that residence time of the waste in the radiant tube is sufficient at the upstream location to carry out evaporation of moisture from the waste and at the downstream location to elevate the temperature of any solids in the waste for completion of carbonization of the waste in the radiant tube; (f) means for discharging from the radiant tube granular char and vapors generated by the carbonization of the waste in the radiant tube; (g) means for transferring the generated and discharged granular char to a discharge collection location; and (h) means for receiving the generated and discharged vapors and flowing the generated and discharged vapors through a succession of condensing tubes so as to condense and separate the vapors into oil, water and methanol from remaining gas. The means for impeding movement of the waste in the radiant tube includes a pair of baffles each being of truncated conical shape and spaced apart upstream and downstream from one another relative to the upstream and downstream ends of the radiant tube. Each of the baffles points downstream of the radiant tube.

The apparatus further comprises means for blowing cooling air across the succession of condensing tubes concurrently as the generated and discharged vapors flow therethrough. The succession of condensing tubes is preferably a succession of banks of finned heat exchanger tubes. The apparatus still further comprises means for receiving and scrubbing the remaining gas to remove any carbon dioxide therefrom and produce a scrubbed remaining gas and means for re-thermolizing the scrubbed remaining gas to produce a manufactured methane gas for routing to the means for heating the radiant tube.

The present invention also is directed to a carbonizing waste processing method which comprises the steps of: (a) rotating a radiant tube having upstream and downstream ends and an interior chamber extending between the upstream and downstream ends; (b) heating the radiant tube to generate a hot zone of a preselected temperature in the interior chamber of the radiant tube for carbonizing waste in the radiant tube so as to generate granular char and vapors from the waste; (c) successively transferring waste into the upstream end of the radiant tube; (d) at upstream and downstream locations in the radiant tube impeding the movement of the waste through the interior chamber of the radiant tube from the upstream end to the downstream end so as to ensure that residence time of the waste in the radiant tube is sufficient at the upstream location to carry out evaporation of moisture from the waste and at the downstream location to elevate the temperature of any solids in the waste for completion of carbonization of the waste in the radiant tube; (e) discharging from the radiant tube granular char and vapors generated by the carbonization of the waste in the radiant tube; (f) transferring the generated and discharged granular char to a discharge collection location; and (g) receiving and flowing the generated and discharged vapors through a succession of condensing tubes so as to condense and separate the vapors into oil, water and methanol from remaining gas.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
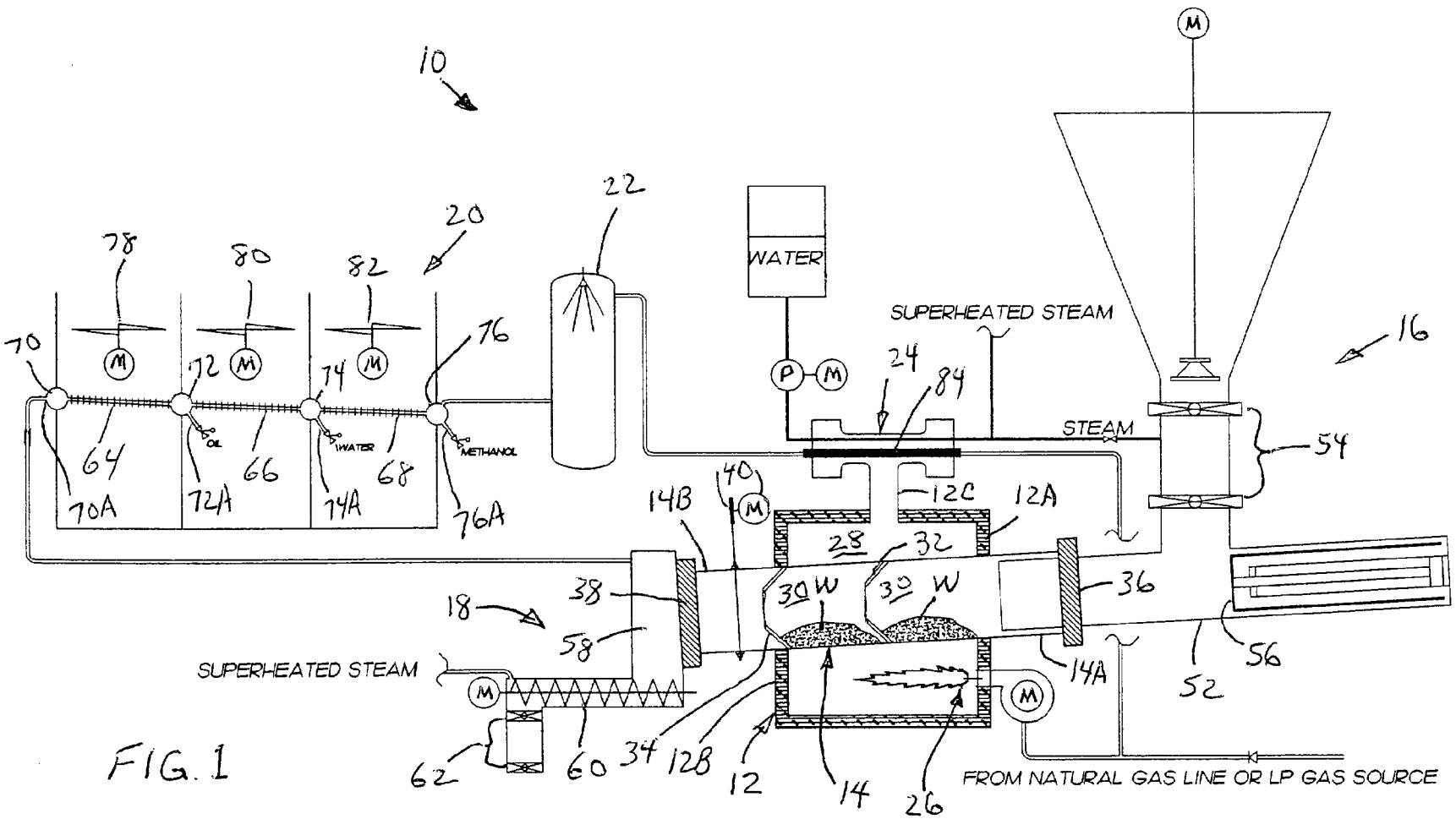
FIG. 1 is a diagrammatic view of a carbonizing waste processing apparatus of the present invention.

Referring to the drawings and particularly to FIG. 1, there is illustrated a diagrammatic view of a carbonizing waste processing apparatus of the present invention, generally designated 10. Basically, the apparatus 10 includes an insulated kiln or furnace 12, a rotary radiant tube 14, a loading mechanism 16, a discharging mechanism 18, and a multi-bank, or multi-tier, heat exchanger-based condensing mechanism 20. Additionally, the apparatus 10 includes a gas scrubber 22 and a gas recuperator 24.

The insulated furnace 12 of the apparatus 10 has a burner 26 therein operable to heat an interior chamber 28 of the furnace 12 to a desired elevated temperature. The rotary radiant tube 14 of the apparatus 10 extends through the interior chamber 28 of the furnace 12 and has upstream and downstream ends 14A, 14B extending out of opposite ends 12A, 12B of the furnace 12. A hot zone 30 is created between the opposite ends 14A, 14B of the tube 14 by the burner 26 of the furnace 12 heating the tube 14 which transforms waste W within the tube 14 into a granular char. The apparatus 10 also has means for impeding movement of the waste W through the radiant tube 14, preferably, in the form of a pair of baffles 32, 34 each being of truncated conical shape and spaced apart upstream and downstream from one another relative to the upstream and downstream ends 14A, 14B of the tube 14. Both baffles 32, 34 point downstream and are disposed within the hot zone 30 of the tube 14. Each baffles 32, 34 constitutes a means for increasing the residence time of the waste within portions of the tube 14 immediately upstream of the respective baffle 32, 34, but for different purposes. Specifically, the upstream baffle 32 retains the waste temporarily in the tube 14 to provide residence time therein sufficient to ensure evaporation of moisture from the waste. The downstream baffle 34 retains the waste temporarily in the tube 14 to provide residence time therein sufficient to elevate the temperature of any solids of the waste to ensure thermolization or burning of the solids into the form of a granular char and thus ensure the completeness of the carbonization of the waste.

The apparatus 10 also includes upstream and downstream members 36, 38 stationarily disposed at the respective upstream and downstream ends 14A, 14B of the tube 14. The upstream and downstream members 36, 38 mount the tube 14 for undergoing rotation about an inclined longitudinal axis A being higher at the upstream end 14A of the tube 14. The apparatus 10 further includes a suitable drive means 40, such as a motor and drive gears, drivingly engaged with the tube 14 adjacent to its downstream end 14B for causing rotation of the tube 14.

Figure 2:
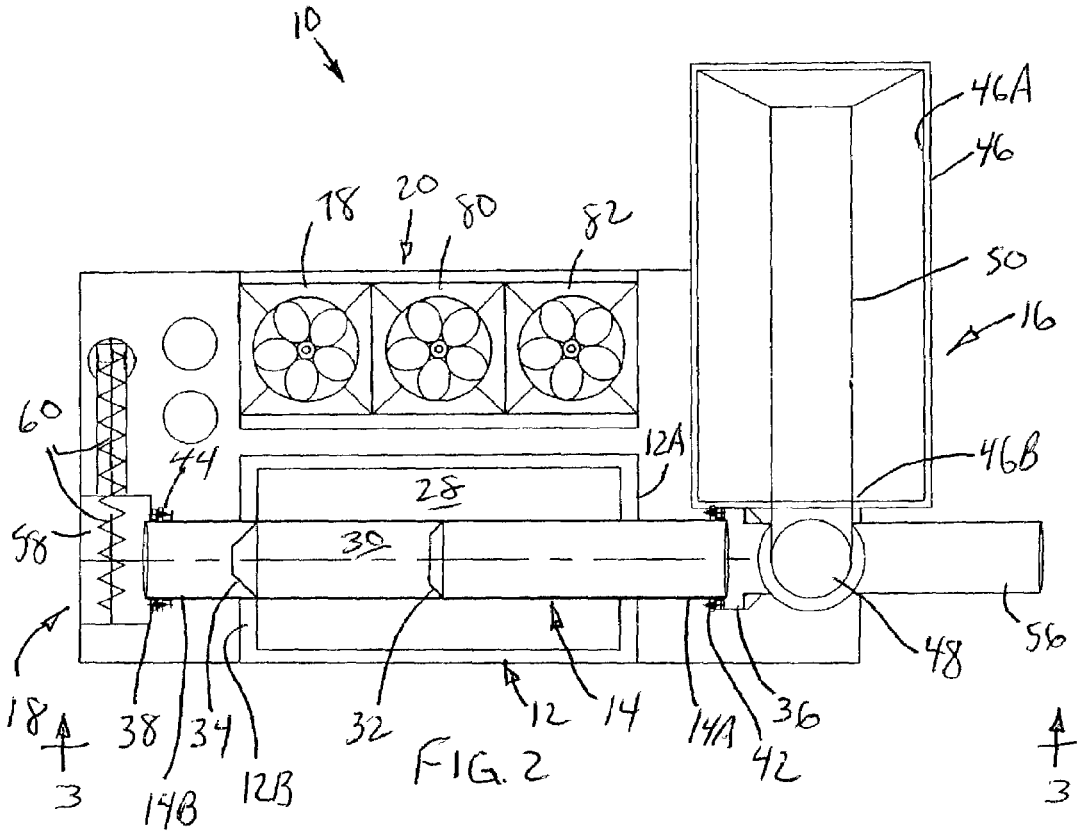
FIG. 2 is a top plan view of the apparatus.
Figure 3:
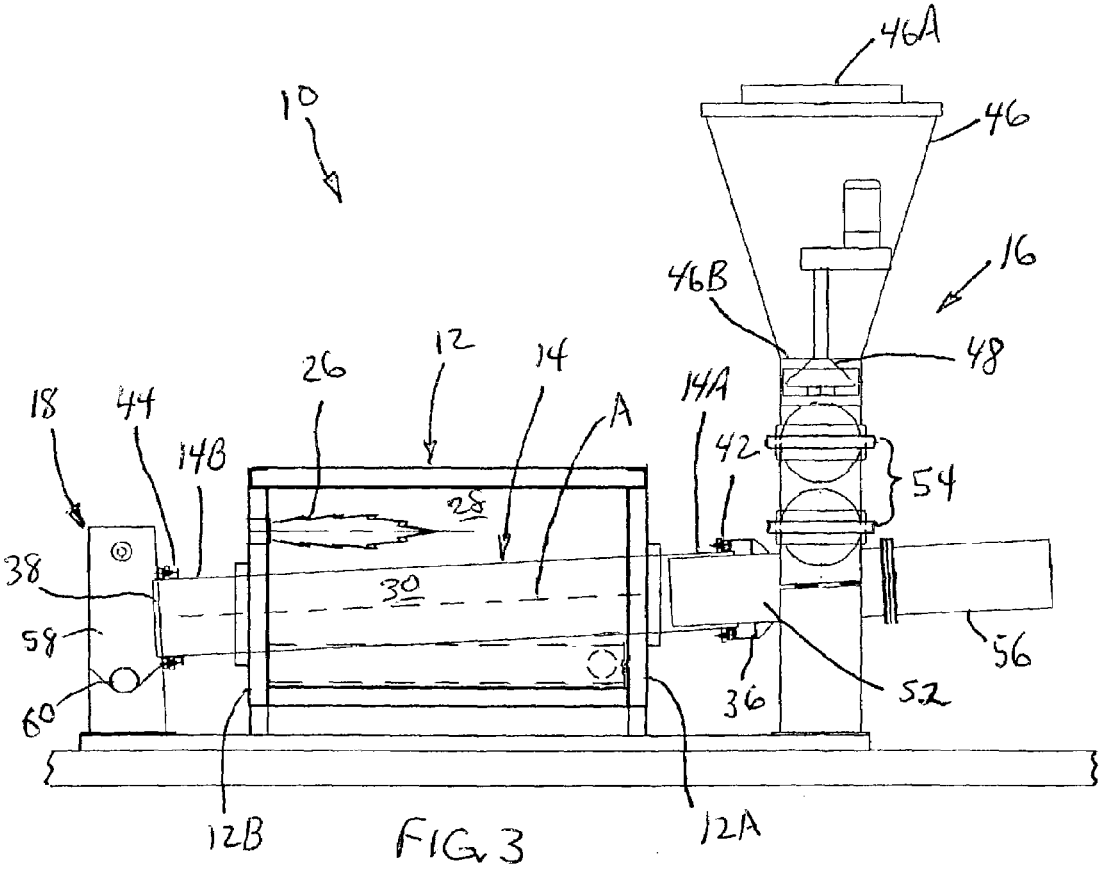
FIG. 3 is a side elevational view of the apparatus as seen along line 3—3 of FIG. 2.

Still further, referring to FIGS. 1 to 3, the apparatus 10 includes annular seals 42, 44 mounted to the upstream and downstream annular members 36, 38 and fitted about the respective opposite ends 14A, 14B of the tube 14 so as to accommodate rotation of the tube 14 relative to the stationary upstream and downstream annular members 36, 38 and, at the same time, prevent escape of internal gases from the upstream and downstream ends 14A, 14B of the tube 14. The ends 14A, 14B of the tube 14 by extending out of the furnace 12 allow the ends 14A, 14B to remain cooler to accommodate the dynamic seals 42, 44 to contain the internal gases. The seals 42, 44 can be any suitable type, such as high temperature graphite type, or water cooled elastomeric type such as Viton or Silicone.

The loading mechanism 16 of the apparatus 10 is connected to the upstream annular member 36 for feeding the waste into the upstream end 14A of the tube 14. The loading mechanism 16 basically includes a hopper 46, a shredder or pulverizer 48, conveyor 50, a loading tube 52, a double valve-controlled chamber 54, and a ram transfer device 56. The hopper 46 has a top inlet 46A for receiving the waste W into the hopper 46, such waste typically being in packaged or bagged form. The pulverizer 48 is located adjacent an outlet end 46B of the hopper 46 and is operable for converting the packaged or bagged waste into a bulk flowable form. The pulverizer 48 also breaks down large waste items for full penetration while processing in the radiant tube 14. The conveyor 50, such as a screw feeder, is disposed in the hopper 46 and operable for transferring the bagged waste contained in the hopper 46 to the pulverizer 48 which then converts the bagged waste into the pulverized bulk waste. The loading tube 52 receives the pulverized bulk waste from the pulverizer 48. The double valve-controlled chamber 54, provided between the pulverizer 48 and the loading tube 52, is operable to open and close sequentially in cycles so as to allow passage of a batch of the pulverized bulk waste each cycle from the pulverizer 48 to the loading tube 52, while maintaining thermal isolation of the loading tube 52 from the hopper 46 and pulverizer 48. The ram transfer device 56, mounted adjacent to and extending into the loading tube 52, is reciprocally operable to move successive batches of the pulverized bulk waste into the upstream end 14A of the radiant tube 14. In addition, preferably, steam from a suitable external superheated steam source is delivered into the double valve-controlled chamber 54 to permit purging of the chamber 54 and the flow of molecular hydrogen therefrom into the loading tube 52 and therefrom into the radiant tube 14 in a sufficient volume to aid in the burning process to form hydrocarbons in the tube 14.

The discharging mechanism 18 of the apparatus 10 is connected to the downstream annular member 38 for receiving from the downstream end 14B of the radiant tube 14 the granular char resulting from the burning of the waste in the tube 14. The discharging mechanism 18 includes a discharge chamber 58 which receives the granular char from the downstream end 14B of the radiant tube 14, a transfer conveyor 60, such as a screw feeder, which receives and conveys the granular char from the discharge chamber 58 to a suitable external collection location, and a double valve-controlled chamber 62 disposed between the transfer conveyor 60 and the discharge collection location. The double valve-controlled chamber 62 is operable to open and close sequentially in cycles so as to allow passage of the granular char while maintaining thermal isolation of the radiant tube 14 from the discharge collection location. In addition, preferably, steam from a suitable external superheated steam source is delivered into the double valve-controlled chamber 62 to permit purging of the chamber 62.

Figure 4:
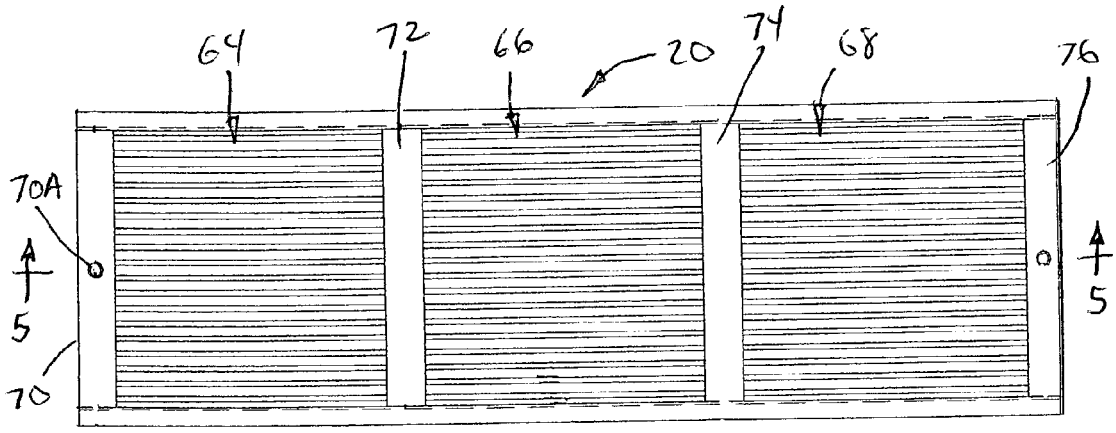
FIG. 4 is an enlarged detailed plan view of a multi-bank heat exchanger-based condensing mechanism of the apparatus.
Figure 5:
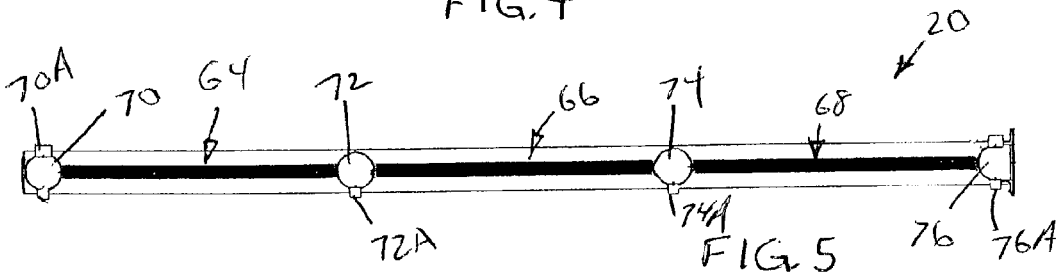
FIG. 5 is a longitudinal sectional view of the condensing mechanism taken along line 5—5 of FIG. 4.
Figure 6:
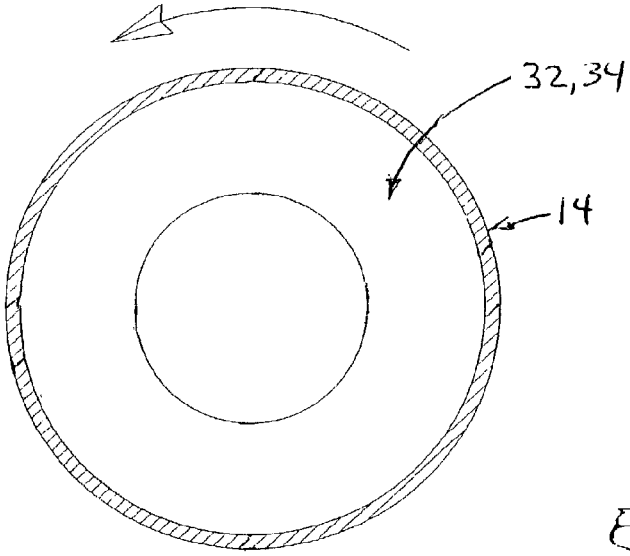
FIG. 6 is an enlarged cross-sectional view of a rotary radiant tube of the apparatus showing one of a pair of conical baffles mounted therein.
Figure 7:
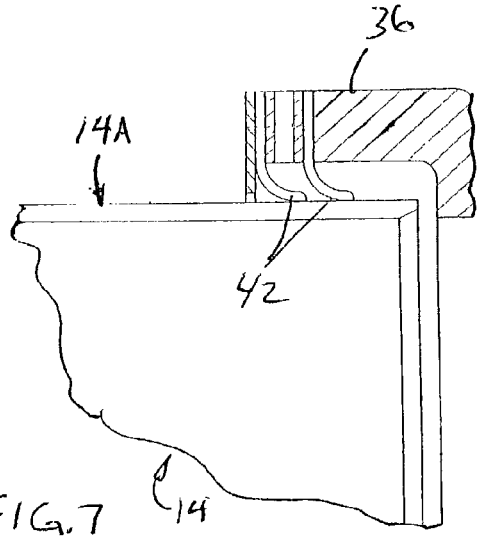
FIG. 7 is an enlarged fragmentary view of the rotary radiant tube showing in sectional form a pair of annular seals that are fitted about each of the opposite ends of the tube.

Referring to FIGS. 1, 4 and 5, the multi-bank, or multi-tier, heat exchanger-based condensing mechanism 20 of the apparatus 10 is disposed downstream of the discharge chamber 58 of the discharging mechanism 18 for receiving the vapors from the downstream end 14B of the radiant tube 14. The condensing mechanism 20 includes a plurality of, preferably three, successive tiers or banks of finned heat exchanger tubes 64, 66, 68 to extract a corresponding number of basic types of liquid products, namely, oil-type fluids (hereafter referred to as oil), water and methanol, and a plurality of, preferably four, manifolds 70, 72, 74, 76 connected in flow communication with, and respectively coupling opposite ends of the respective banks of finned tubes 64, 66, 68. The vapors from the discharge chamber 58 flow into an initial manifold 70 of the condensing mechanism 20 via the inlet 70A thereon and then flow through the successive banks of finned tubes 64, 66, 68 and the intermediate manifolds 72, 74, where the vapors are continuously and successively condensed and separated into oil, water and methanol and discharged therefrom at outlets 72A, 74A, 76A of the respective manifolds 72, 74, 76, with a remaining gas then separately outputted from the last manifold 76. The condensing mechanism 20 also includes a plurality of fans 78, 80, 82, each associated with and dedicated to one of the banks of finned tubes 64, 66, 68 which cause flow of air over and past the exterior surfaces of the finned tubes 64, 66, 68 and manifolds 70, 72, 74, 76 so as to constitute in conjunction therewith a heat exchanger of the condensing mechanism 20. The separated water is preferably discharged from the condensing mechanism 20 to a suitable external collection location. The separated methanol is discharged from the condensing mechanism 20 and collected and stored for further refinement. The separated oil discharged from the condensing mechanism 20 is frequently of low quality, having little commercial value. Thus, the separated oil is preferably piped back into the radiant tube 14 to convert into volatile gas, consisting mainly of methane. Then, after several cycles through the radiant tube 14, the oil breaks down to gas and char.

Referring to FIGS. 1 and 2, the gas scrubber 22 of the apparatus 10, for example being a wet alkali type scrubber, is connected in flow communication with the last manifold 76 of the condensing mechanism 20 and operable to receive and scrub the remaining gas from the condensing mechanism 20 to remove any carbon dioxide therefrom and output the scrubbed remaining gas. The recuperator 24 of the apparatus 10 is connected in flow communication to the gas scrubber 22 and includes a catalyst filled tube 84 which receives and re-thermolizes the scrubbed remaining gas before routing it back to the burner 26 of the furnace 12 for use as fuel therein. The catalyst in the tube 84 preferably is made up of activated carbon and activated alumina to maximize the formation of methane from the remaining gas. The recuperator 24 also is connected in flow communication with a flue gas outlet 12C of the furnace 12 which provides the necessary heat for the catalyst of the recuperator 24. Using this scrubbed and re-thermolized, or manufactured, methane gas as fuel for the burner 26 reduces or even eliminates fuel costs. When processing plastics and other high BTU materials, it has been found that this manufactured gas production exceeds the demand from the furnace 12 by a significant amount. In these cases, the manufactured gas can be diverted to other devices such as converted diesel generators or boilers.

In the normal operating mode, the steps of the method of operation of the apparatus 10 are as follows. The burner 26 of the furnace 12 is initially fired and brought up to an operating temperature of about 1850° F. using LP or natural gas, and then the onsite manufactured methane gas described above can be substituted as the fuel to operate the burner 26 of the furnace 12. The switching of fuels from the initial firing to the manufactured methane occurs automatically as the supply of methane gas is made available through the carbonization process.

The waste, such as contaminated materials, transferred to the disposal site in a prepackaged or bagged form carried out at the point of the waste production, is then placed into the hopper 46 of the loading mechanism 16 where it is pulverized into the form of a flowable mass waste. To load the radiant tube 14, the flowable mass waste is successively transferred in batches through the double valve-operated chamber 54 of the loading mechanism 16 to the loading tube 52 from the ram transfer device 56 of the loading mechanism 16 successively delivers the batches of waste into the hot zone 30 of the radiant tube 14. Within the hot zone 30 of the radiant tube 14 the waste W is burned by high heat such as from 1100°–1500° F., while undergoing a tumbling action inside the rotating radiant tube 14. The upstream and downstream disposed truncated conical baffles 32, 34 ensure that residence time in the radiant tube 14 is sufficient to successively carrying out moisture evaporation and temperature elevation of solids for completion of carbonization of the waste.

Both the granular char and generated vapors discharge from the rotary radiant tube 14 into the discharge chamber 58 of the discharging mechanism 18. The granular char is transferred from the discharge chamber 58 by the transfer conveyor 60 to and through the double valve-controlled chamber 62 to the discharge collection location. The internal operating pressure of the radiant tube 14 is preferably maintained at a magnitude which is somewhat less than 10 psig to facilitate the transportation of generated vapors to and separation of the generated vapors by the multiple banks of finned tubes 64, 66, 68 of the condensing mechanism 20. The remaining gas from the condensing mechanism 20 is received and scrubbed at the gas scrubber 22 to remove any carbon dioxide therefrom and the outputted scrubbed remaining gas is then received and re-thermolized by catalyst of a gas recuperator 24 to produce a substantially methane gas that is routed back to the burner 26 of the furnace 12 for use as fuel therein.

The apparatus 10 also may employ a suitable control system (not shown) which, for example, may include a multi-channel programmable PID controller and pluralities of on-off switches, limit switches, temperature sensors, proportional control valves and motors, to control all functions of the apparatus 10. In conclusion, some unique characteristics and features of the apparatus 10 and effects imposed on the waste and condensed and separated products by the apparatus 10 are as follows: (1) the waste is exposed to red heat by means of tumbling the waste inside the externally heated rotary radiant tube 14; (2) the waste is processed in an oxygen deprived atmosphere; (3) the residence time of the waste within the radiant tube 14 before discharge is controlled by the presence of the upstream and downstream conical baffles 32, 34 in the radiant tube 14; (4) the catalyst present in the recuperator 24 re-thermolizes or manufactures the remaining gas into substantially methane gas which is used to fuel the burner 26 of the furnace 12; and (5) the conveying of the waste within the hot zone 30 is achieved by the rotation of the radiant tube 14.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A carbonizing waste processing apparatus, comprising:

(a) a radiant tube having upstream and downstream ends and an interior chamber extending between said upstream and downstream ends;

(b) means drivingly coupled to said radiant tube for rotating said radiant tube;

(c) means for heating said radiant tube to generate a hot zone of a preselected temperature in said interior chamber therein for carbonizing waste in said radiant tube so as to generate granular char and vapors from the waste;

(d) means for successively transferring the waste into said upstream end of said radiant tube;

(e) means disposed at upstream and downstream locations in said radiant tube for temporarily impeding movement of the waste through said interior chamber of said radiant tube from said upstream end to said downstream end thereof so as to ensure that residence time of the waste in said radiant tube is sufficient at said upstream location to carry out evaporation of moisture from the waste and at said downstream location to elevate the temperature of any solids in the waste for completion of carbonization of the waste in said radiant tube, said means for impeding movement of the waste in said radiant tube including a pair of baffles each being of truncated conical shape and spaced apart upstream and downstream from one another relative to said upstream and downstream ends of said radiant tube;

(f) means for discharging from said radiant tube granular char and vapors generated by the carbonization of the waste in said radiant tube;

(g) means for transferring the generated and discharged granular char to a discharge collection location; and (h) means for receiving the generated and discharged vapors and flowing the generated and discharged vapors through a succession of condensing tubes so as to condense and separate the vapors into oil, water and methanol from remaining gas.

2. The apparatus of claim 1 further comprising:

means for blowing cooling air across said succession of condensing tubes concurrently as the generated and discharged vapors flow therethrough.

3. The apparatus of claim 1 wherein said succession of condensing tubes is a succession of banks of finned heat exchanger tubes.

4. The apparatus of claim 3 further comprising:

means for blowing cooling air across said succession of banks of finned heat exchanger tubes concurrently as the generated and discharged vapors flow therethrough.

5. The apparatus of claim 1 further comprising:

means for receiving and scrubbing the remaining gas to remove any carbon dioxide therefrom and produce a scrubbed remaining gas.

6. The apparatus of claim 5 further comprising:

means for re-thermolizing the scrubbed remaining gas to produce a manufactured methane gas for routing to said means for heating said radiant tube.

7. The apparatus of claim 1 wherein each of said baffles points downstream of said radiant tube.

8. The apparatus of claim 1 further comprising:

upstream and downstream annular members stationarily disposed at said respective upstream and downstream ends of said radiant tube and mounting said radiant tube for undergoing rotation about a longitudinal axis with said upstream end of said radiant tube elevated above said downstream end thereof.

9. The apparatus of claim 8 further comprising:

a pair of seals each mounted to one of said upstream and downstream annular members and fitted to said corresponding upstream and downstream ends of said radiant tube so as to accommodate rotation of said radiant tube relative to said stationary upstream and downstream annular members while preventing escape of vapors from between said upstream and downstream ends of said radiant tube and said upstream and downstream annular members.

10. The apparatus of claim 1 further comprising:

a pair of double valve-controlled chambers respectively disposed upstream and downstream of said corresponding upstream and downstream ends of said radiant tube and being operable to open and close so as to allow passage respectively of the waste to and granular char from said radiant tube while maintaining thermal isolation of said radiant tube.

11. A carbonizing waste processing apparatus, comprising the steps of:

(a) an insulated furnace having a rotary radiant tube extending through said furnace and rotatable relative thereto and having upstream and downstream ends extending from opposite ends of said furnace and an interior chamber extending between said upstream and downstream ends of said radiant tube, said furnace also having a burner operable at a preselected operating temperature so as to heat said radiant tube and generate a hot zone of a preselected temperature in said interior chamber of said radiant tube for carbonizing waste in said radiant tube so as to generate granular char and vapors from the waste;

(b) means drivingly coupled to said radiant tube for rotating said radiant tube;

(c) means for receiving packaged waste and for pulverizing the packaged waste into waste of a flowable mass form;

(d) means for successively transferring batches of the pulverized waste into said upstream end of said radiant tube;

(e) a pair of baffles each of truncated conical shape and disposed at one of upstream and downstream locations in said radiant tube for temporarily impeding movement of the waste through said interior chamber of said radiant tube from said upstream end to said downstream end thereof so as to ensure that residence time of the waste in said radiant tube is sufficient at said upstream location to carry out evaporation of moisture from the waste and at said downstream location to elevate the temperature of any solids in the waste for completion of carbonization of the waste in said radiant tube;

(f) means for discharging from said radiant tube granular char and vapors generated by the carbonization of the waste in said radiant tube;

(g) means for transferring the generated and discharged granular char to a discharge collection location; and (h) means for receiving the generated and discharged vapors and flowing the generated and discharged vapors through a succession of condensing tubes so as to condense and separate the vapors into oil, water and methanol from remaining gas.

12. The apparatus of claim 11 further comprising:

means for blowing cooling air across said succession of condensing tubes concurrently as the generated and discharged vapors flow therethrough.

13. The apparatus of claim 11 wherein said succession of condensing tubes is a succession of banks of finned heat exchanger tubes.

14. The apparatus of claim 13 further comprising:

means for blowing cooling air across said succession of banks of finned heat exchanger tubes concurrently as the generated and discharged vapors flow therethrough.

15. The apparatus of claim 11 further comprising:

means for receiving and scrubbing the remaining gas to remove any carbon dioxide therefrom and produce a scrubbed remaining gas.

16. The apparatus of claim 15 further comprising:

means for re-thermolizing the scrubbed remaining gas to produce a manufactured methane gas for routing said means for heating said radiant tube.

17. The apparatus of claim 11 further comprising:

upstream and downstream annular members stationarily disposed at said respective upstream and downstream ends of said radiant tube and mounting said radiant tube for undergoing rotation about a longitudinal axis with said upstream end of said radiant tube elevated above said downstream end thereof.

18. The apparatus of claim 17 further comprising:

a pair of seals each mounted to one of said upstream and downstream annular members and fitted to said corresponding upstream and downstream ends of said radiant tube so as to accommodate rotation of said radiant tube relative to said stationary upstream and downstream annular members while preventing escape of vapors from between said upstream and downstream ends of said radiant tube and said upstream and downstream annular members.

19. The apparatus of claim 11 further comprising:

a pair of double valve-controlled chambers one disposed between said means for pulverizing waste and said means for successively transferring batches of pulverized waste and the other disposed between the discharge collection location and said means for transferring the generated and discharged granular char to the discharge collection location, said double valve-controlled chambers being operable to open and close so as to allow passage respectively of the pulverized waste and the granular char while maintaining thermal isolation of said radiant tube.

* * * * *